United States Patent [19]

Feis

[11] 4,381,845

[45] May 3, 1983

[54] DISPENSER FOR SHOTGUN SHELLS

[76] Inventor: Mark J. Feis, 14381 Riverdale Rd., Brighton, Colo. 80601

[21] Appl. No.: 196,434

[22] Filed: Oct. 14, 1980

[51] Int. Cl.[3] ..... F42B 39/00

[52] U.S. Cl. ..... 221/185; 221/264; 224/196; 224/239

[58] Field of Search ..... 221/264, 263, 185, 281; 222/361; 224/196, 224, 226, 239, 252, 269

[56] References Cited

U.S. PATENT DOCUMENTS

| | | | |
|---|---|---|---|
| 1,455,970 | 5/1923 | Resek | 221/361 X |
| 2,037,045 | 4/1936 | Rinkhoff | 221/264 X |
| 2,499,652 | 3/1950 | Kirby | 221/185 X |
| 3,014,618 | 12/1961 | Kireta | 221/185 X |
| 3,091,364 | 5/1963 | Ayres | 221/185 X |
| 3,212,690 | 10/1965 | Green | 224/224 X |
| 3,393,838 | 7/1968 | Syverson | 222/361 X |

FOREIGN PATENT DOCUMENTS

| | | | |
|---|---|---|---|
| 3929 | 11/1892 | Sweden | 224/239 |

*Primary Examiner*—F. J. Bartuska
*Attorney, Agent, or Firm*—Ancel W. Lewis, Jr.

[57] ABSTRACT

A dispenser for shotgun shells includes an upper supply housing (16) and a lower ejecting housing (41) arranged transverse to the supply housing and, when mounted on a belt, located directly opposite the hand of the user. An ejecting member (61) is moved through the ejecting housing by the depression of a forwardly projecting actuator (71) advantageously located directly opposite the heel portion at the rear of the palm of the hand of the user. Shells (14) are dispensed one at a time through a release opening (49) in the bottom upon each depression of the actuator, and springs (73) in the ejecting housing automatically return the ejecting member after each dispensing operation to load another shell for dispensing. The housings (16, 41) are made as a one-piece body and a waterproof lid (71) closes the shell fill opening in the supply housing to prevent the shells from becoming wet.

4 Claims, 8 Drawing Figures

DISPENSER FOR SHOTGUN SHELLS

TECHNICAL FIELD

This invention generally relates to dispensers for articles, and more particularly to a novel and improved dispenser specifically adapted for dispensing shotgun shells.

BACKGROUND ART

In the past hunters have relied primarily on a shell vest to carry shells for hunting purposes. Some of the disadvantages of the shell vest are that the shells tend to bounce while walking and climbing, the vest is not waterproof, and considerable manipulation is required to remove and load each shell. Some attempts have been made to provide a container-type dispenser for shells but for the most part these have involved special body configurations, a large number of parts, and relatively complex mechanisms in the dispensing unit. An example of a known prior art dispenser is shown in U.S. Pat. No. 3,105,611.

Accordingly, it is a general objective of the present invention to provide a novel and improved dispenser for shotgun shells that is of a relatively simple design, is capable of easy grasping, and results in quick loading.

DISCLOSURE OF INVENTION

A dispenser for shotgun shells and the like is disclosed that is specifically adapted to be hung on the belt of the user and readily operated by one hand. The dispenser includes an upper supply housing and a lower ejecting housing extending transverse to the supply housing which are preferably formed as a one-piece plastic body with a sliding lid and are of a waterproof design. An ejecting member in the ejecting housing is moved from a first to a second position by the depression of an external forwardly projecting actuator whereby a shell is discharged via a release opening in the bottom of the ejecting housing into the hand of the user. Compression springs between a removable rear end cap and the ejecting member automatically return the ejecting member to the first position, whereupon another shell is received from the supply housing into the ejecting member for subsequent dispensing when the movement of the ejecting member is repeated.

BRIEF DESCRIPTION OF DRAWINGS

The details of this invention will be described in connection with the accompanying drawings, in which.

DETAILED DESCRIPTION

Figure 1:
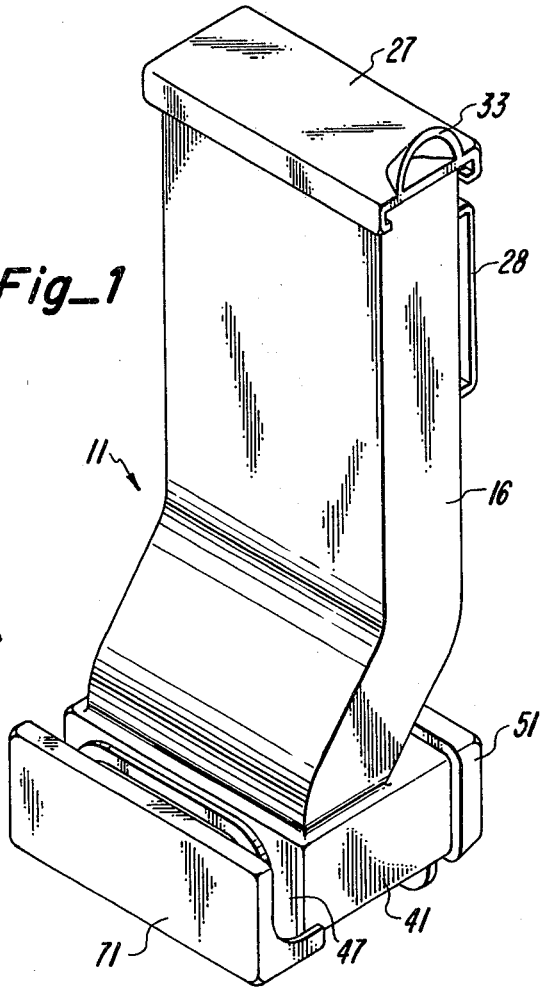
FIG. 1 is a front perspective view of a dispenser for shotgun shells embodying features of the present invention.

Referring now to the drawings, the dispenser 11 shown, generally stated, includes an upper shell supply portion 12 that is constructed and arranged for providing a means for containing a stack of shotgun shells to be dispensed and a lower shell ejecting portion 13 providing a means for dispensing the shells from the ejecting portion 13 one at a time. The dispenser shown and described herein is particularly suited for dispensing 12-gauge shotgun shells indicated at 14.

The supply portion 12 includes a generally tubular supply housing 16 of a rectangular shape having a front wall 17, a rear wall 18, and opposed sidewalls 19 and 21 with inner surfaces which define an internal elongated supply passage 22. These inner surfaces are of a shape and size that will arrange the shells for proper dispensing and will guide the shells in a gravity feed downwardly therethrough. The top of the housing 16 is open to provide a generally rectangular fill opening 23 and the bottom of the housing 16 is open to provide a generally rectangular bottom opening 24 through which the lowermost shell in the stack will freely slide and fall by the forces of gravity.

The supply housing 16 has a straight upper section **16*a* and a forwardly and downwardly inclined lower section 16*b* arranged so that the ejecting housing 41 described hereinafter will extend laterally out from the supply housing and the rear end thereof will be substantially flush or coplanar with the rear wall 18 of the supply housing. A belt loop 28 for relatively wide belts is formed at the top on the rear wall 18** for removably fastening the dispenser to the belt of the user in a suspended manner.

The supply housing 16 is provided with a pair of outturned flanges 25 and 26 at the top which cooperate with a top closure lid 27 having a generally channel-shaped cross section with a pair of inturned flanges 29 and 30 along opposite sidewalls of the channel shape and a stop flange 31. At the opposite end of the stop flange 31 there is a catch flange 32 that has a beveled surface that slides over the top edge of the sidewall 21 and a vertical inside flange edge that engages the sidewall 21 of the supply housing once the lid has been moved to the closed position so that the catach flange edge 31 prevents the lid from moving. Catch flange edge 31 extends the full lateral extent of the sidewall to provide overhanging surfaces on all sides of the supply housing in the closed position.

To move the lid to the open position, the catch flange edge 31 is pivoted up by the application of force by a finger to an upstanding curved lip 33 formed at the end of the lid above the catch flange. In the closed position the side flanges 25 and 26, in cooperation with flanges 29 and 30 together with flanges 31 and 32, provide a continuous overhanging edge to form a waterproof closure of the top opening 23 to prevent the contained shells 14 from becoming wet.

The ejecting portion 13 includes an ejecting housing 41 having a top wall 42, a bottom wall 43, opposed sidewalls 44 and 45 having inner surfaces that define an ejecting passage 46. Housing 41 further has a front wall 47 with a front opening 48 and is formed with an opening 49 at the rear. Rear opening 49 is normally closed by a removable rear end cap 51. The end cap 51 has upper and lower inturned flanges 53 and 54 and snap-fits onto the housing 41. Housing 41 has an enlarged end portion 52 with forwardly diverging surfaces and a retaining lip for the ready removal and replacement of the cap 51 and for forming a waterproof closure of the housing. A release opening 49 is formed in the bottom wall for discharging the shell. The supply housing 16 and ejecting housing 41 are shown as made as a one-piece body which is preferably of a molded plastic material.

Figure 2:
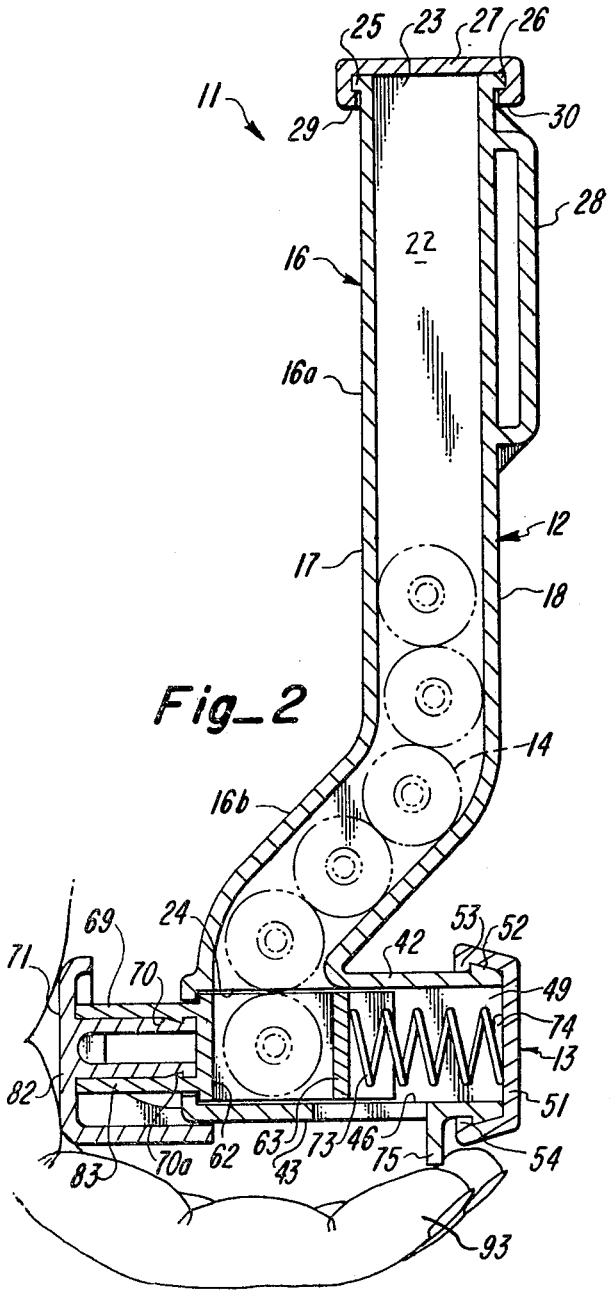
FIG. 2 is a vertical sectional view through the dispenser shown in FIG. 1 with the ejecting member in a forward at-rest position and with a shell shown loaded in the ejecting member for dispensing.

An ejecting member 61 is mounted to slide through and be guided by the interior wall surfaces of the ejecting housing 41. The ejecting member 61 is an open grid-like frame having a front wall 62, a rear wall 63, and opposed sidewalls 64 and 65 with the sidewalls extending rearwardly of rear wall 63. These walls 62, 63, 64 and 65 are sized and shaped to define a shell-receiving cavity 66, of a dimension selected in relation to the size of the shell, that is open at the bottom and the top into which the lowerm shell from the supply housing will fall by gravity, as shown in FIG. 2. The ejecting member has an oval-shaped forward body portion 69 with an internal passage 70 open at the front that extends through the aperture 48 in the front wall of the ejecting housing and serves as a retaining wall to hold the shells in the housing during the rearward dispensing stroke.

As best seen in FIG. 2, when the ejecting member 61 is in the forward or at-rest position, the front wall 62 of the ejecting member is urged against the inside of the front wall 47 of the ejecting housing so as to close the front of the ejecting housing. This arrangement effects a waterproof closure for the front end of the ejecting housing 41. It is understood that more elaborate conventional seals could be provided between housing and member if water became a substantial problem, but the above described construction has been found adequate for a suitable waterproof joint.

An actuator 71 is removably mounted on the front end of the ejecting member that extends forwardly of the ejecting housing and is adapted to be engaged by a heel or butt portion at the rear of the palm of the hand of the user. The actuator 71 is located a selected distance from the belt loop so that, when the arm of the user depends down in an extended position, the heel portion of the hand at the rear of the palm is directly opposite the center of the actuator 71.

The actuator 71 is removable from the ejecting member 61 and includes an L-shaped portion 82 having an upright front leg and a lower rearwardly extending leg and a pair of laterally spaced rearwardly projecting portions 83 that slidably extend into and snap-fit into the socket 70 of the forwardly projecting portion 69 of the ejecting member 61. The snap-fit shown is provided by a rearwardly converging inner surface on the inside of portion 69 that forms a retaining edge at 70*a*, together with a complementary shape on the end of projections 83 indicated at 83*a*.

Figure 3:
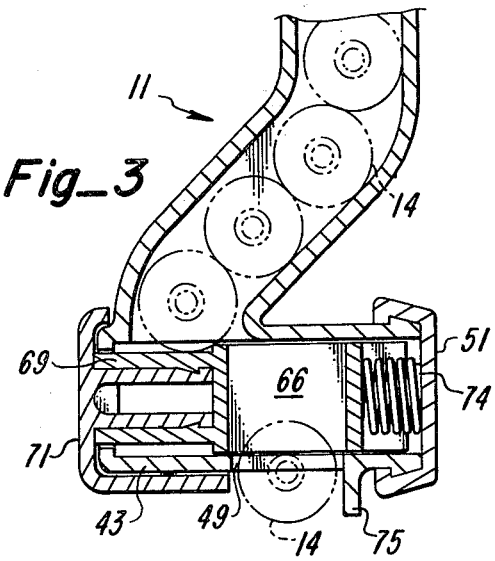
FIG. 3 is a vertical sectional view through the lower part of the dispenser shown in FIG. 2 with the ejecting member moved to the dispensing position and showing a shell being released through the bottom release opening.

The ejecting housing 41 has a depending finger flange 75 adapted to be engaged by the tips of the finers so that, when the palm is placed under the release opening 49, a squeezing action with the finger tips and the heel of the hand on 71 with these hand portions brought toward one another moves the ejecting member 61 from a first position shown in FIG. 2 to a rearward second position shown in FIG. 3.

For the automatic return of the ejecting member 61 there are shown three compression springs 73 mounted on associated knobs or projections 74 on the inside wall of the rear end cap 51. The rear end cap 51 is removable, as above described, to enable insertion of the springs into position as well as the insertion of the ejecting member into housing 41 for ready assembly and disassembly.

Figures 4, 5:
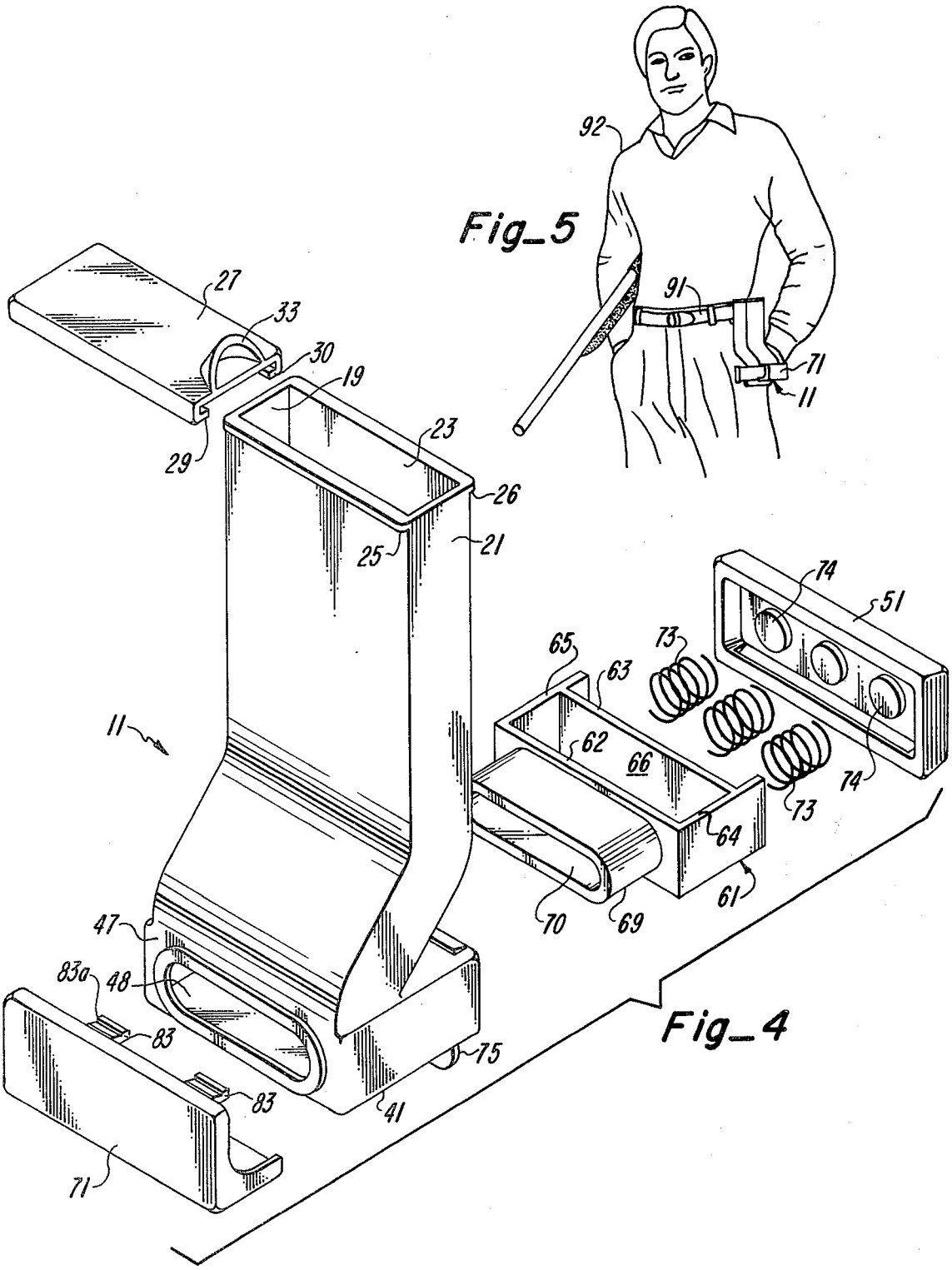
FIG. 4 is an exploded view of the dispenser shown in FIGS. 1-3.
FIG. 5 is a perspective view of a person wearing a belt on which a dispenser of the present invention is carried.
Figure 6:
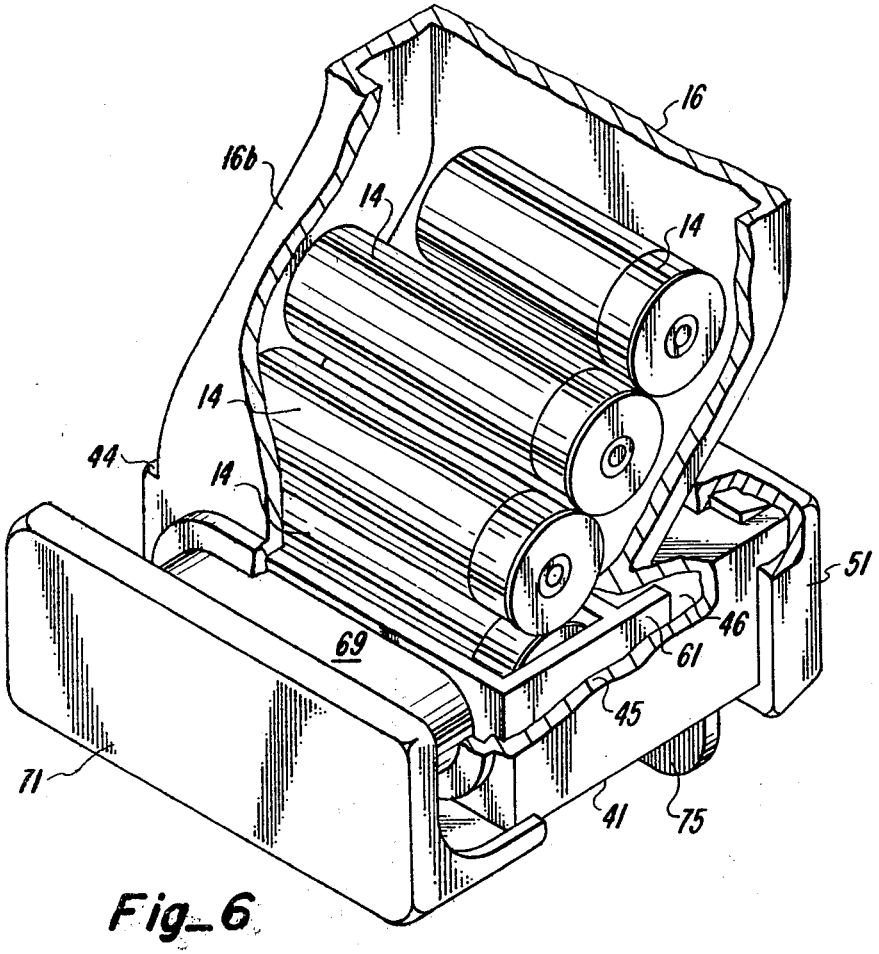
FIG. 6 is an enlarged perspective view of the lower portion of the dispenser with wall portions broken away to show interior parts.
Figure 7:
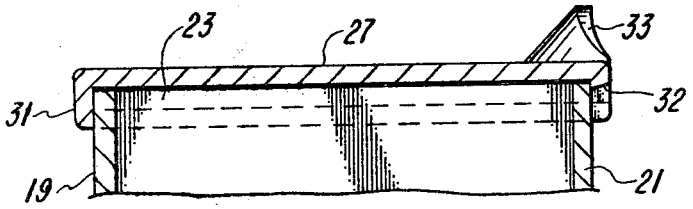
FIG. 7 is a fragmentary sectional view showing the manner of latching the lid.
Figure 8:
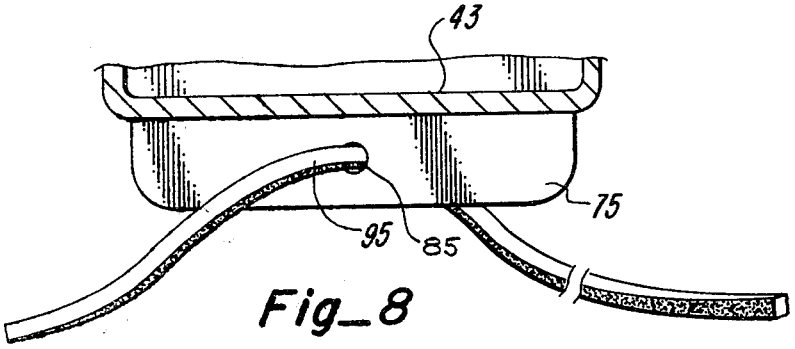
FIG. 8 is a fragmentary view showing the finger flange provided with an aperture and leg strap to facilitate securing the lower end of the dispenser to the leg of the user.

The dispenser 11 is specifically adapted to be portable and carried by a belt 91 of a user 92, as shown in FIG. 5. The device when carried by the belt has the actuator 71 opposite the heel or butt portion at the rear of the palm of the hand 93 when the arm is in an extended depending manner, as above described. The fingers of the hand are positioned on flange 75 and the palm is under the release opening 49. As shown in FIG. 8, as an optional feature the finger flange 75 may be provided with an aperture 85 through which a strap 95 extends to enable the dispenser to be tied to the leg of the user.

In the dispensing operation, with the ejecting member in the at-rest position the lowermost shell 14 in the supply housing 16 falls into the ejecting member cavity 66 and is ready for dispensing to load the ejecting member. The dispensing is accomplished by the depression of the actuator 71 and ejecting member 61 to the rear position of FIG. 3, at which time the loaded shell 14 will fall through the release opening 24 and from the dispenser. When the hand forces are released from the actuator 71, the springs 73 then return the ejecting member to the forward position and the lowermost shell in the supply housing falls into the cavity 66 to reload the ejecting member for the next dispensing operation.

The interior dimensions of the supply and ejecting housings and ejecting member of the above described device which have been found particularly suitable for dispensing two sizes of 12-gauge shotgun shells are:

Supply housing 16:
- Depth: 0.94 inches
- Width: 3.13 inches
- Length of straight section: 5.43 inches
- Length of inclined section 2.25 inches Ejecting housing 41:
- Height: 0.94 inches
- Width: 3.13 inches
- Length: 2.56 inches
- Height of supply housing and ejecting housing excluding flange: 8.50 inches Ejecting member 61:
- Width: 1.00 inches
- Length: 3.13 inches In order to locate the actuator 71 for ready engagement by the heel of the palm of a depending hand, the distance from the center of the belt loop to the center of the actuator that has been found to be particularly effective is about 6.75 inches.

While the present invention has been described with a certain degree of particularity, it is understood that the present disclosure has been made by way of example and that changes in details of structure may be made without departing from the spirit thereof.

What is claimed is:

1. A dispenser for shotgun shells and the like comprising:

a supply housing of generally rectangular shape having a front wall, a rear wall, and opposed sidewalls with inner surfaces defining an elongated supply passage of a size and shape related to the size and shape of the shells being dispensed to guide a stack of the shells downwardly from a top fill opening through a bottom opening, said supply housing being formed with a straight upper section and a forwardly and downwardly inclined lower section, a closure lid for said fill opening having a generally channel-shaped cross section with a pair of side flanges that turn in from the sides of the lid and slide under a pair of outward flanges projecting out from the top of the sidewalls of the supply housing, said lid having a stop flange at one end that extends down along one side wall, a catch flange at the opposite end, and an up-standing lip projecting up from said catch flange whereby upon the application of a force to said lip the fastening flange is raised to a position to enable the movement of the lid to an open position;

an ejecting housing of generally rectangular shape having a top wall, a bottom wall and opposed sidewalls having inner surfaces defining an ejecting passage, there being an opening in the top wall to receive a shell from the bottom of the supply housing and a release opening in the bottom wall, said ejecting housing having an opening in the front, an opening in the rear, and a removable rear end cap closing the rear opening;

an ejecting member slidably mounted in and guided by the inner surfaces of said ejecting housing, said ejecting member being in the form of an open grid-like frame and having a front wall, a rear wall, and opposed sidewalls defining a shell-receiving cavity that in its forward position is under the open bottom of the supply housing, said sidewalls extending beyond said rear wall, said ejecting member having a forward extension projecting through the opening in the front wall and shaped to form a receiving socket, and an actuator mounted on the front end of said ejecting member externally of said ejecting housing adapted to be emgaged by the hand of the user to move said ejecting member to the second position, said actuator having a forward upright leg and a lower rearwardly extending leg disposed to extend under said ejecting housing in the second position; and resilient means mounted in said ejecting housing between said rear end cap and the rear wall of said ejecting member for automatically returning said ejecting member from said second position to said first position after a shell-dispensing operation with the then lowermost shell in the supply housing dropping into said cavity in the first position for said ejecting member.

2. A dispenser as set forth in claim 1 including a finger flange projecting down from the bottom wall of said ejecting housing forwardly of said release opening whereby, when said actuator and said finger flange are engaged by the hand of the user in a squeezing action, a shell in said ejecting member is discharged into the palm of the hand of the user.

3. A dispenser as set forth in claim 2 including means for fastening said finger flange to the leg of the user.

4. A dispenser as set forth in claim 1 wherein a front wall of the ejecting member and a front wall of the ejecting housing form a closure for the front of said ejecting housing when said ejecting member is in the first position.

* * * * *